US006386898B1

(12) United States Patent
Taguchi

(10) Patent No.: US 6,386,898 B1
(45) Date of Patent: May 14, 2002

(54) CONNECTOR FITTING CONSTRUCTION

(75) Inventor: Naoto Taguchi, Shizuoka (JP)

(73) Assignee: Yazaki Corporation, Tokyo (JP)

( * ) Notice: Subject to any disclaimer, the term of this patent is extended or adjusted under 35 U.S.C. 154(b) by 0 days.

(21) Appl. No.: 09/365,780

(22) Filed: Aug. 3, 1999

(30) Foreign Application Priority Data

Aug. 3, 1998 (JP) ..... 10-219125

(51) Int. Cl.[7] ..... H01R 13/627
(52) U.S. Cl. ..... 439/352; 439/489
(58) Field of Search ..... 439/345, 188, 439/350–358, 488–489, 310

(56) References Cited

U.S. PATENT DOCUMENTS

| | | | | |
|---|---|---|---|---|
| 5,749,747 A | 5/1998 | Inaba et al. | ..... | 439/358 |
| 5,848,912 A | 12/1998 | Okabe | ..... | 439/489 |
| 5,919,056 A | 7/1999 | Suzuki et al. | ..... | 439/352 |

FOREIGN PATENT DOCUMENTS

| | | | | |
|---|---|---|---|---|
| DE | 197 33 893 A1 | 2/1998 | ..... | H01R/13/64 |
| JP | 5-81967 | 11/1993 | ..... | H01R/13/639 |
| JP | 6-89759 | 3/1994 | ..... | H01R/13/703 |
| JP | 9-180820 | 7/1997 | | |
| JP | 9-185974 | 7/1997 | | |
| JP | 9-237-653 | 9/1997 | | |
| JP | 9-245892 | 9/1997 | ..... | H01R/13/64 |
| JP | 10-50408 | 2/1998 | ..... | H01R/13/639 |
| JP | 10-289756 | 10/1998 | | |

*Primary Examiner*—Khiem Nguyen
(74) *Attorney, Agent, or Firm*—Sughrue Mion, PLLC

(57) ABSTRACT

A connector fitting construction in which a half-fitted condition is positively prevented when fitting a pair of female and male connectors together, and a connector-inserting force, required for the fitting operation, can be reduced. In this connector fitting construction, one of the two connectors has a slider receiving portion (4), formed by an exclusive-use housing (3*b*), and has a lock arm (6) on which a lock beak (7), having a slanting surface, is formed. A slider (10) has a pair of abutment projections (14) formed on a lower surface of a slider body (11), and a slide groove (13). The abutment projections (14) can be received respectively in side spaces (4*a*) provided respectively at opposite sides of the lock arm (6) within the slider receiving portion (4). The lock beak (7) can be fitted in the slide groove (13). Notches (33) for allowing a temporary upward movement of a front end portion (11*a*) of the slider body (11) are formed in the exclusive housing (3*b*), and a forwardly downwardly-slanting surface is formed on a front edge (33*a*) of each notch (33).

5 Claims, 13 Drawing Sheets

CONNECTOR FITTING CONSTRUCTION

BACKGROUND OF THE INVENTION

1. Field of the Invention

The present invention relates to a connector fitting construction in which a half-fitted condition is positively prevented by a resilient force of a resilient member mounted in at least one of a pair of female and male connectors to be fitted and connected together, and the connector, fitted on the mating connector, is positively locked.

The present application is based on Japanese Patent Application No. Hei. 10-219125, which is incorporated herein by reference.

2. Description of the Related Art

Usually, many electronic equipments are mounted on a vehicle such as an automobile, and therefore, naturally, various types of female and male connectors are provided at connection ends of various kinds of wires forming wire harnesses or the like.

Various half-fitting prevention connectors, in which a condition of fitting between female and male connectors, can be detected, have been used, and one such example is disclosed in Unexamined Japanese Utility Model Publication No. Hei. 5-81967.

This half-fitting prevention connector comprises a pin-type connector, having a plurality of juxtaposed pin contacts mounted therein, and a socket-type connector having a plurality of juxtaposed socket contacts mounted therein. A movable cover is mounted on the outer periphery of the female connector for sliding movement back and forth. Spring receiving portions are provided at opposite side portions of this movable cover, respectively, and compression springs are received respectively in these spring receiving portions, and extend in a forward-rearward direction.

In this half-fitting prevention connector, however, although the half-fitted condition can be prevented by the resilient force of the compression springs, there is encountered a problem that when trying to fit the two connectors together while holding the opposite side surfaces of the movable cover with the hand, the movable cover can not be moved, and therefore the efficiency of the fitting operation is low.

On the other hand, a connector fitting construction, which has been disclosed in Unexamined Japanese Patent Publication No. Hei. 10-50408 and so on, may solve the above problem.

A male connector 1A, shown in FIGS. 9 and 10, comprises a housing 3 which includes a connector housing 3*a*, having a terminal receiving chamber, and an exclusive-use housing 3*b* forming a slider receiving portion 4 for slidably receiving a slider 10A (described later). Guide grooves 5 for respectively guiding opposite side portions of a body of the slider 10A are formed respectively in opposite side portions of the exclusive-use housing 3*a*, and a spring receiving portion 3*c* of a tubular shape is formed at a rear end of each of the guide grooves 5.

A lock arm 6 is formed integrally with the exclusive-use housing 3*b* at a widthwise central portion thereof, and extends in a fitting direction, the lock arm 6 having an elastic, free end portion. The lock arm 6 has a lock beak 7 formed on an upper surface thereof, and the lock beak 7 has a slanting surface, and a housing lock 8 for retaining engagement with a mating connector is formed on a lower surface of the lock arm at a distal end thereof. Displacement prevention projections 8*a* for preventing the displacement of the lock arm 6 are formed on the upper surface of the lock arm 6, and face away from the housing lock 8. Side spaces 4*a* for receiving part of the slider 10A are formed at opposite sides of the lock arm 6, respectively. The slider 10A includes an elastic slider arm 12 provided at a generally central portion of the slider body 11, and the slider arm 12 has a pair of abutment projections 14 formed respectively at opposite side portions of a lower surface thereof at a front end thereof. The slider 10A includes a depressing portion 15, which is formed on an upper surface thereof at a rear end thereof, and is operated when canceling the fitting connection, and a slide groove 13 formed in the slider arm 12 and the depressing portion 15. Spring retaining portions 16 for respectively retaining compression springs 9 are formed respectively at opposite side portions of a lower portion of the slider body 11 at the rear end thereof. A displacement prevention portion 17 for prevention the displacement of the lock arm 6 is formed at the front end of the slider body 11.

The female connector (the other connector) 2A, shown in FIG. 11, includes a housing 21 having a terminal receiving chamber, a pair of stopper projections 22A, which are formed on a surface of the housing 21 so as to abut respectively against the abutment projections 14 of the slider 10A during the connector-fitting operation, a slanting projection 23, which is provided between the stopper projections 22A, and has a slanting surface for flexing the lock arm 6, and an engagement groove 24 which is formed at a rear side of the slanting projection 23 so as to be engaged with the housing lock 8.

A procedure of fitting the above female and male connectors together will now be described. When the slider 10A, having the compression springs 9 held respectively on the spring retaining portions 16, is pushed into the slider receiving portion 4 of the male connector 1A from the front side thereof as shown in FIG. 9, the slider body 11 moves along the guide grooves 5 toward the rear end of the male connector. At this time, the abutment projections 14, formed at the lower surface of the slider arm 12, are received respectively in the side spaces 4*a* formed respectively at the opposite sides of the lock arm 6. Then, the compression springs 9 are received in the spring receiving portions 3*c*, respectively, and the lock beak 7 is fitted in the slide groove 13, so that the slider 10A is slidably mounted in the slider receiving portion 4.

In the above condition shown in FIG. 10, the slider 10A is urged forward by the resilient force of the compression springs 9, and the front end of the depressing portion 15 is retainingly held against the lock beak 7 in the slide groove 13, and the displacement prevention projections 8*a*, formed at the distal end of the lock arm 6, abut against the displacement prevention portion 17 formed on the lower surface of the slider 10A at the front end thereof, thereby preventing the upward displacement of the lock arm 6.

Then, when the operation for fitting the female and male connectors together is started as shown in FIG. 11, the stopper projections 22A of the female connector 2A are inserted respectively into the side spaces 4*a* (see FIG. 9), formed respectively at the opposite sides of the lock arm 6 of the male connector 1A, and these stopper projections 22A abut against the abutment projections 14 of the slider 10A, respectively. From this time on, the resilient force of the compression springs is produced. At this stage, pin contacts 31, mounted in the female connector 2A, are not yet fitted respectively in socket contacts 30 mounted in the male connector 1A.

Then, when the fitting operation further proceeds, the slider 10A is pushed rearwardly against the resilient force of the compression springs, so that the housing lock 8, formed at the distal end of the lock arm 6, abuts against the slanting projection 23 of the female connector 2A. If the pushing operation is stopped in this half-fitted condition, the male and female connectors 1A and 2A are returned or moved away from each other (that is, in a disconnecting direction opposite to the fitting direction) by the resilient force of the compression springs 9, and therefore such half-fitted condition can be easily detected.

Then, when the fitting operation further proceeds, the slider arm 12 of the slider 12A is flexed (elastically deformed) upwardly by the lock beak 7, so that the abutment of the stopper projections 22A with the abutment projections 14 of the slider 10A is released. Then, under the influence of the compression springs, the slider arm 12 slides over the stopper projections 22A, and also the housing lock 8, formed at the distal end of the lock arm 6, slides over the slanting projection 23, and is engaged in the engagement groove 24.

Then, the slider 10A is returned to its initial position under the influence of the compression springs, so that the displacement prevention portion 17 of the slider 10A abuts against the displacement prevention projections 8*a* of the lock arm 6, as shown in FIG. 13. As a result, the lock arm 6 is locked, and the female and male connectors are held in a completely-fitted condition, and the contacts 30 are completely connected to the contacts 31, respectively.

This completely-fitted condition can be detected through the sense of touch, obtained when the housing lock 8 of the lock arm 6 slides over the slanting projection 23, and also can be easily detected by viewing the position of the returned slider 10A.

In the male and female connectors 1A and 2A, a half-fitted condition can be detected, and the fitting operation can be easily effected. However, the slider body 11 and the slider arm 12 need to be elastically deformed at the time when the abutment projections 14 of the slider 10A are disengaged respectively from the stopper projections 22A during the fitting operation. Therefore, the connector-inserting force, required for fitting the male and female connectors 1A and 2A together, must be abruptly increased midway through the fitting operation, which has invited a problem that the fitting operation can not be carried out smoothly.

SUMMARY OF THE INVENTION

With the above problem in view, it is an object of the present invention to provide a connector fitting construction in which a half-fitted condition is positively prevented when fitting a pair of female and male connectors together, and a connector-inserting force, required for the fitting operation, can be reduced.

To achieve the above object, according to the present invention, there is provided a connector fitting construction which comprises a female connector including a housing into which a terminal is insertable, a male connector fittable to the female connector, the male connector including a housing into which another terminal is insertable, wherein one of the female and male connectors including a slider receiving portion, and the other one of the female and male connectors including a pair of stopper projections formed on the housing thereof, a spring member receivable in the housing of one of the female and male connectors, a slider slidably insertable in the slider receiving portion, the slider having a pair of abutment projections, and a notch, in which a front end portion of the slider is receivable, formed above the slider receiving portion, wherein, when the female and male connectors are fitted to each other, the abutment projections respectively abut against the stopper projections, the slider is moved rearwardly in the slider receiving portion against a resilient force of the spring member, and the front end portion of the slider is received in the notch so as to release abutment of the abutment projections with the stopper projections.

In the above connector fitting construction, preferably, each of the stopper projections has a forwardly downwardly-slanting surface formed on a front end thereof, and the notch has a forwardly downwardly-slanting surface formed on a front edge thereof.

In the above connector fitting construction, preferably, the slider is moved forwardly in the slider receiving portion in accordance with the resilient force of the spring member as the abutment of the abutment projections with the stopper projections is released.

In the above connector fitting construction, preferably, one of the female and male connectors includes a lock arm having a lock beak with a sliding surface, and the slider includes a groove formed therein, and wherein the front end portion of the slider is moved upwardly so as to be received in the notch as a front edge of the groove slides onto the sliding surface of the lock beak.

In the above connector fitting construction, preferably, a half-fitted condition of the female and male connectors is prevented by the resilient force of the spring member.

In the above connector fitting construction, before the fitting operation of the male connector is effected, the slider, having the spring member held in the housing, is pushed into the housing from the front side thereof. At this time, the abutment projections, formed on a lower surface of the slider body, are received respectively in spaces provided respectively at opposite sides of the lock arm, so that the slider is slidably mounted in the housing.

Then, when the operation for fitting the female and male connectors together is started, the stopper projections of the female connector are inserted respectively into the spaces in the male connector, and abut against the abutment projections of the slider, respectively. Then, when the fitting operation proceeds, the slider is pushed rearward against the resilient force of the spring member.

If this pushing operation is stopped in this half-fitted condition, the female and male connectors are moved away from each other (that is, in a disconnecting direction opposite to the fitting direction) under the influence of the spring member, and therefore such half-fitted condition can be easily detected.

In the above connector fitting construction of the present invention, the housing has the notches for allowing a temporary upward movement of the front end portion of the slider body, and the front end of each of the stopper projections has the slanting surface, and the front edge of each of the notches has the slanting surface, and these slanting surfaces are slanting forwardly downwardly in the fitting direction.

Therefore, the abutment projections, abutted respectively against the stopper projections, are urged upwardly by the slanting surfaces of the stopper projections.

Then, the fitting operation further proceeds, and when the slider is moved to the predetermined position at the rear portion of the housing against the resilient force of the spring member, the front end portion of the slider is temporarily received in the notches disposed above the slider, and therefore the abutment of the abutment projections of the slider with the stopper projections of the other connector can be smoothly released.

Then, immediately, the front end portion of the slider is moved forward under the influence of the compression spring, and slides over the stopper projections, and abuts against the slanting front edges of the notches, and is returned to be again received in the housing, and is further moved forward to be returned to the initial position.

By thus moving the slider body upward without flexing it, the connector-inserting force, required for fitting the female and male connectors together can be reduced, and the two connectors can be completely fitted together with the low inserting force, and the efficiency of the fitting operation can be enhanced.

DETAILED DESCRIPTION OF THE PREFERRED EMBODIMENT

One preferred embodiment of a connector fitting construction of the present invention will now be described in detail with reference to FIGS. 1 to 8.

Figure 1:
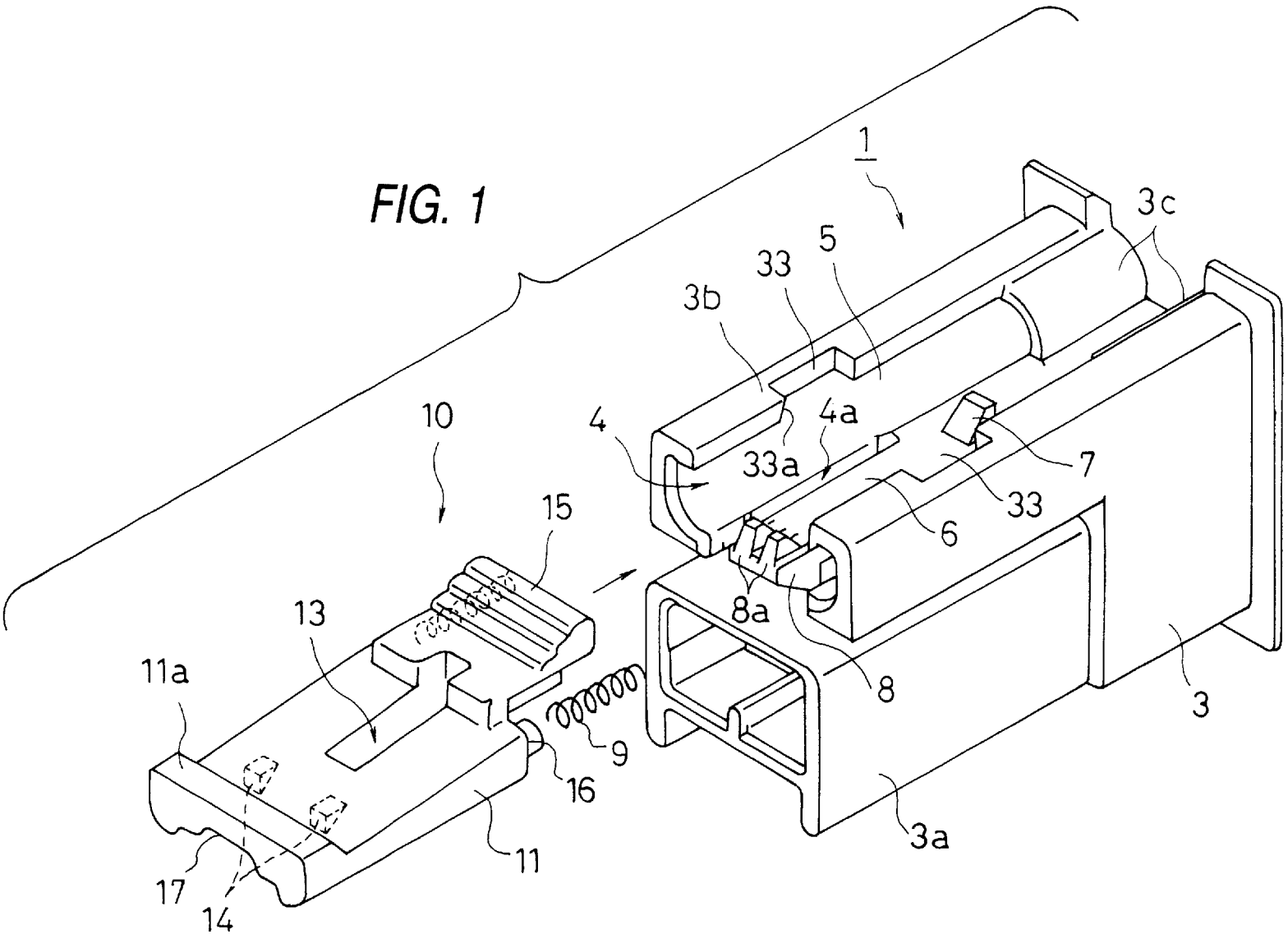
FIG. 1 is an exploded, perspective view showing a male connector of a connector fitting construction of the present invention.

As shown in FIG. 1, the male connector 1 (one of the pair of male and female connectors 1 and 2 related to the connector fitting construction of this embodiment) comprises a housing 3, and this housing 3 includes a connector housing 3*a*, which has a terminal receiving chamber (in the form of a through hole) for receiving a predetermined number of socket contacts, and also has a terminal insertion port open to its front side, and an exclusive-use housing 3*b* provided above the connector housing 3*a* so as to slidably receive a slider 10 (described later).

The exclusive-use housing 3*b* is provided to form a slider receiving portion 4 for receiving the slider 10, and extends in a fitting direction, and is open upwardly. A pair of guide grooves 5 for respectively guiding opposite side portions of a slider body 11 are formed respectively in opposite side portions of the exclusive-use housing 3*b*. A spring receiving portion 3*c* of a tubular shape is formed at a rear end of each of the guide grooves 5.

A pair of notches 33 for allowing a temporary upward movement of a front end portion 11*a* of the slider body 11 are formed respectively in opposite side edge portions of the opening in the exclusive-use housing 3*b*. A forwardly downwardly-slanting surface is formed on a front edge of each of the notches 33.

A lock arm 6 of the cantilever type is formed integrally with the exclusive-use housing 3*b* at a widthwise central portion thereof, and extends in the fitting direction. A lock beak 7, having a forwardly downwardly-slanting surface, is formed on an upper surface of the lock arm 6, and a housing lock 8 for retaining engagement with a female housing 21 (described later) is formed on a lower surface of the lock arm 6 at a distal end thereof. Displacement prevention projections 8a for preventing the displacement of the lock arm 6 are formed on the upper surface of the lock arm 6, and face away from the housing lock 8.

Side spaces 4*a* for respectively receiving abutment projections 14 and 14 (described later) of the slider 10 are formed at opposite sides of the lock arm 6, respectively.

The slider 10 has the pair of abutment projections 14 and 14 formed respectively at opposite side portions of a lower surface thereof at a front end portion thereof. The slider 10A includes a depressing portion 15, which is formed on an upper surface thereof at a rear end thereof, and is operated when canceling the fitting connection, and a slide groove 13 formed in the slider body 11 and the depressing portion 15. Spring retaining portions 16 for respectively retaining compression springs 9 are formed respectively at opposite side portions of a lower portion of the slider body 11 at the rear end thereof. A displacement prevention portion 17 for prevention the displacement of the lock arm 6 is formed at the front end of the slider body 11.

Figure 2:
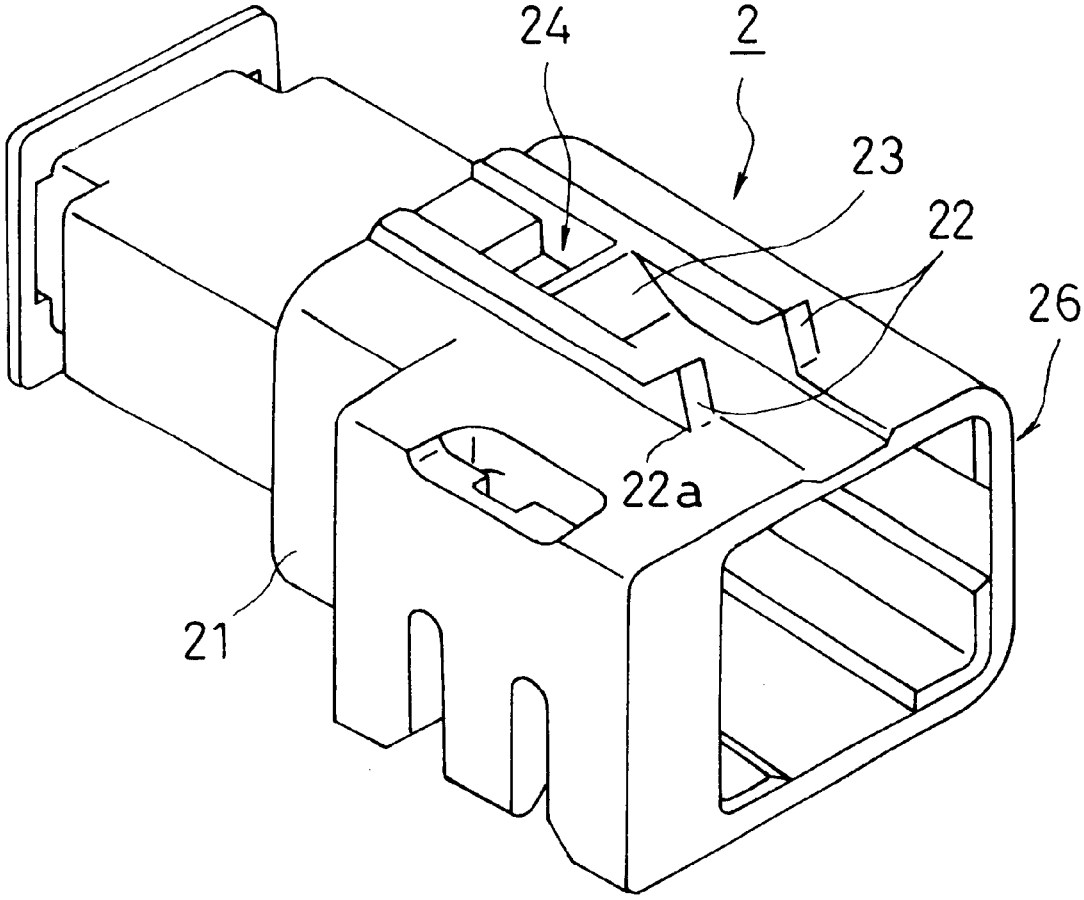
FIG. 2 is a perspective view of a female connector of the connector fitting construction of the present invention.
Figure 4:
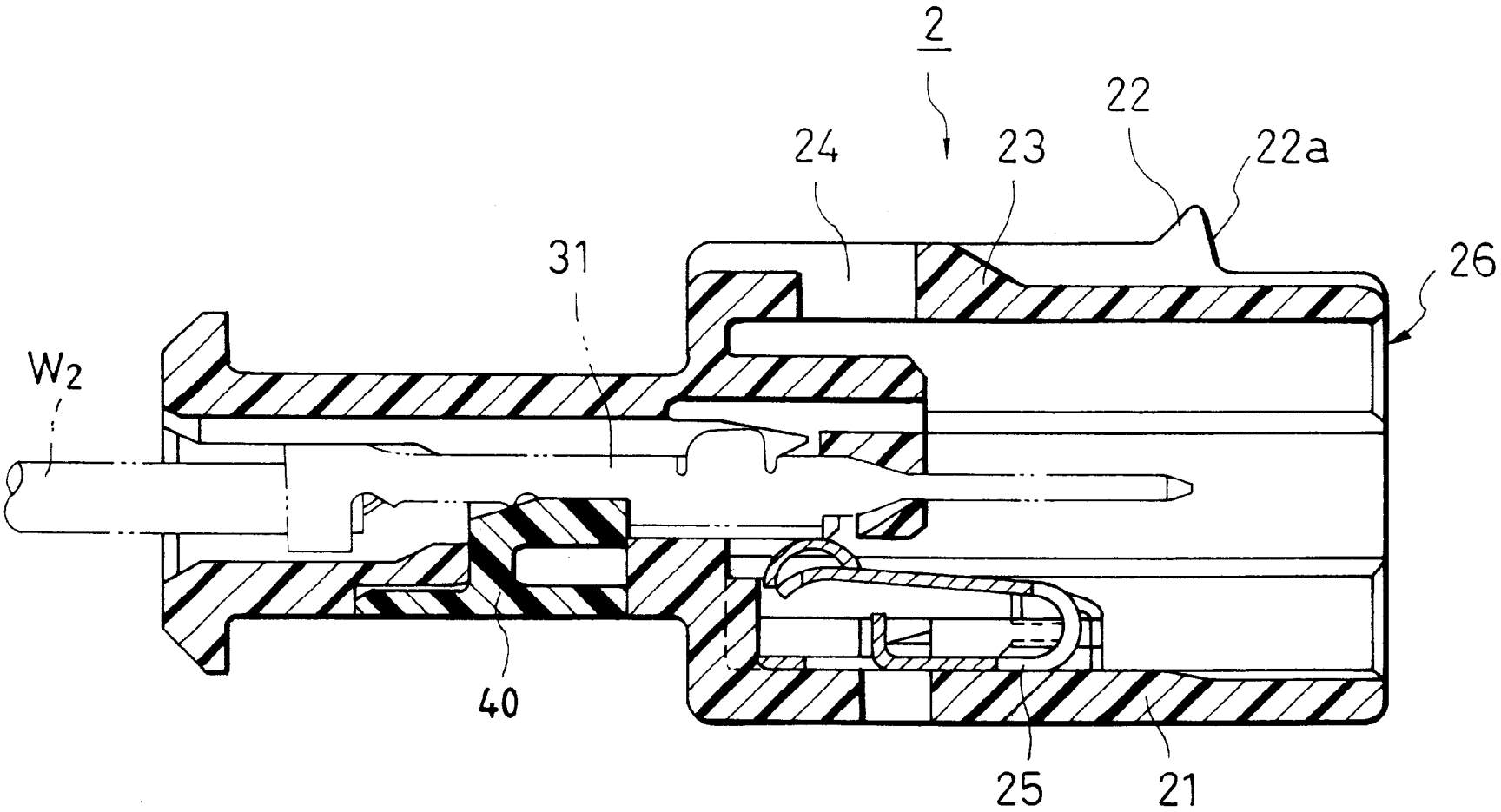
FIG. 4 is a vertical cross-sectional view of the female connector of FIG. 2.

As shown in FIGS. 2 and 4, the female connector (the other connector) 2 includes a terminal receiving chamber (in the form of a through hole) for receiving a predetermined number of pin contacts, and has a housing insertion port 26 open to its front side. The female connector 2 includes a pair of stopper projections 22, which are formed on a surface of the housing 21 so as to abut respectively against the abutment projections 14 of the slider 10 during the connector-fitting operation, a slanting projection 23, which is provided between the stopper projections 22 and 22, and has a slanting surface, and an engagement groove 24 which is formed at a rear side of the slanting projection 23 so as to be engaged with the housing lock 8.

A forwardly downwardly-slanting surface 22*a* is formed on a front end of each stopper projection 22, and these slanting surfaces 22*a*, when engaged respectively with the abutment projections 14 of the slider 10, urge the slider 10 upwardly.

Next, a procedure of fitting the female and male connectors of the above construction together will be described.

Figure 3:
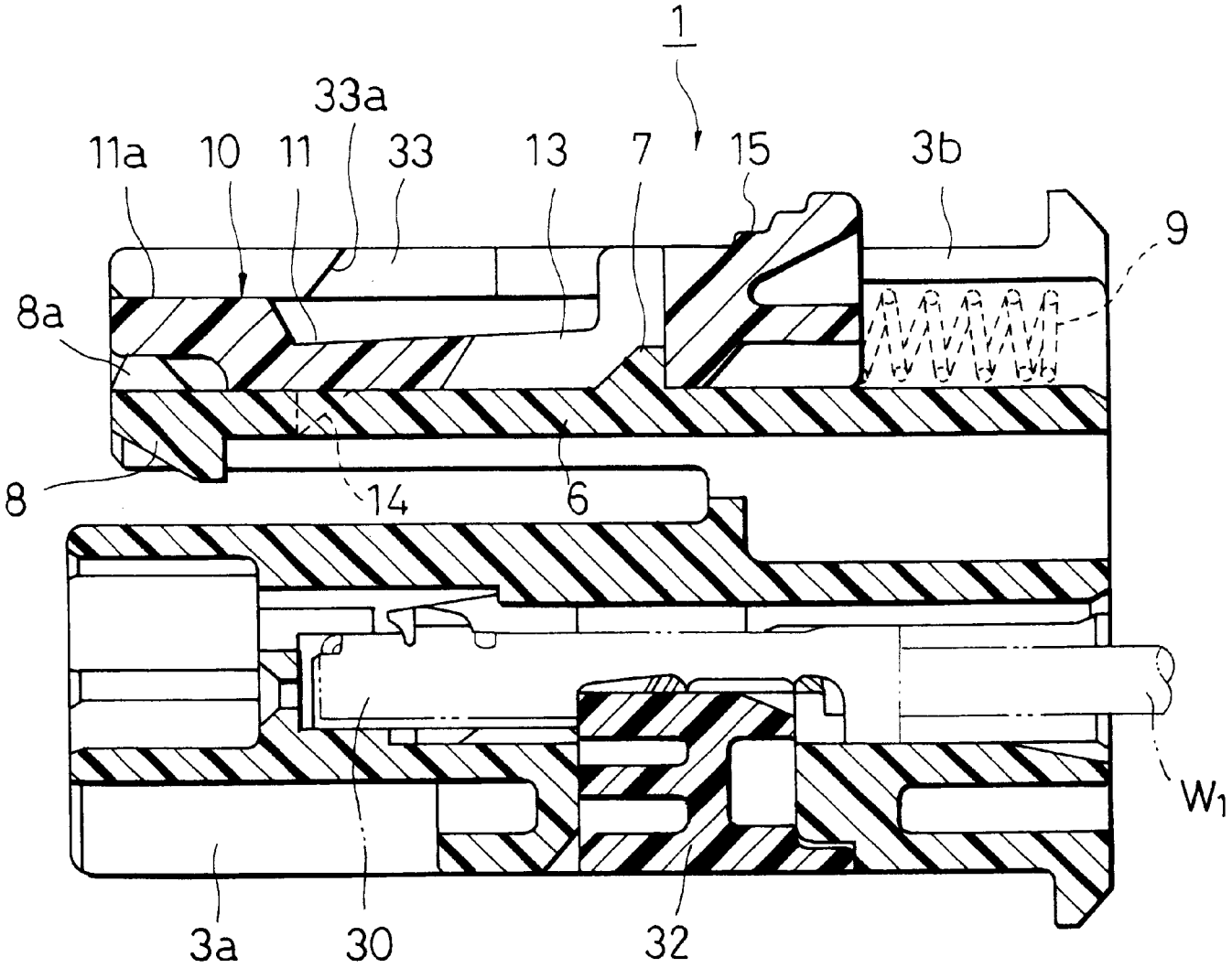
FIG. 3 is a vertical cross-sectional view of the male connector of FIG. 1 having a slider mounted therein.

First, for mounting the slider 10 on the male connector 1, the slider 10, having the compression springs 9 held respectively on the spring retaining portions 16, is pushed into the slider receiving portion 4 of the male connector 1 from the front side thereof as shown in FIGS. 1 and 3. At this time, the abutment projections 14 of the slider 10 are received respectively in the side spaces 4a formed respectively at the opposite sides of the lock arm 6. Then, the compression springs 9 are received in the spring receiving portions 3*c*, respectively, and the lock beak 7 on the lock arm 6 is fitted in the slide groove 13 in the slider 10, so that the slider 10 is slidably mounted in the slider receiving portion 4.

In the above condition shown in FIG. 3, the slider 10 is urged forward by the resilient force of the compression springs 9, and the front end of the depressing portion 15 is retainingly held against the lock beak 7 in the slide groove 13, and the displacement prevention projections 8*a*, formed at the distal end of the lock arm 6, abut against the displacement prevention portion 17 formed on the lower surface of the slider 10 at the front end thereof, thereby preventing the upward displacement of the lock arm 6.

Then, the socket contacts 30, each clamped to an end portion of a wire WI, are inserted into the housing 3 from the rear side thereof, and are retained by housing lances formed within the terminal receiving chamber, and a double-retaining holder 32 is attached to the housing 3.

Then, as shown in FIG. 4, the pin contacts 31, each clamped to an end portion of a wire W2, are inserted into the housing 21 of the female connector 2 from the rear side thereof, and are retained by housing lances formed within the terminal receiving chamber, and a double-retaining holder 40 is attached to the housing 21. A short-circuit spring 25 for short-circuiting the specified pin contacts to each other or for canceling a short-circuited condition is mounted within the housing 21.

Next, the operation for fitting the male and female connectors 1 and 2 (related to the connector fitting construction of this embodiment) together will be described.

Figure 5:
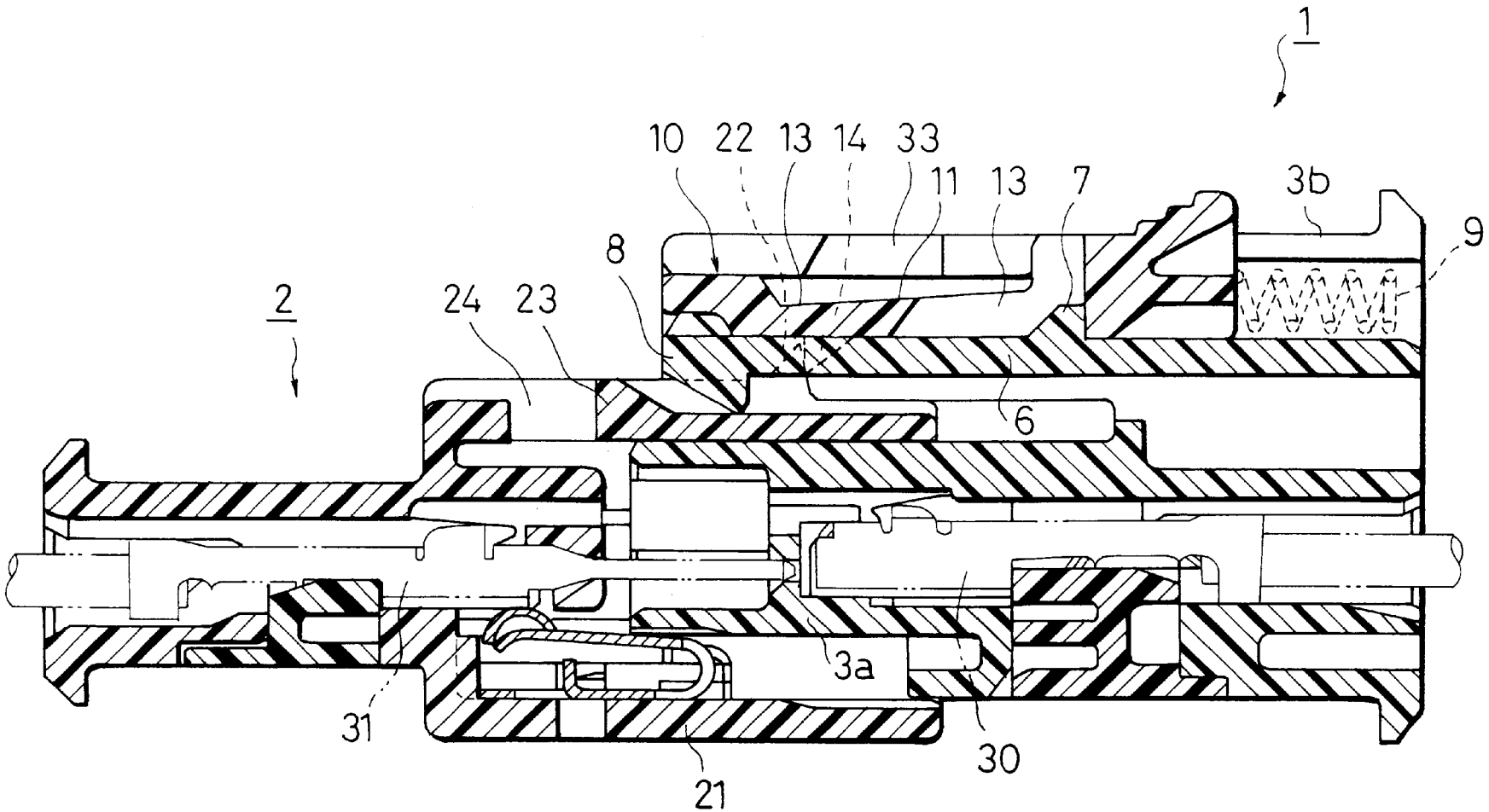
FIG. 5 is a view explanatory of an operation, showing an initially-fitted condition of the female and male connectors.

When the operation for fitting the female and male connectors together is started as shown in FIG. 5, the stopper projections 22 of the female connector 2 are inserted respectively into the side spaces 4*a* (see FIG. 1), formed respectively at the opposite sides of the lock arm 6 of the male connector 1, and these stopper projections 22 abut against the abutment projections 14 of the slider 10A, respectively. From this time on, the resilient force of the compression springs 9 is produced, and also the forwardly downwardly-slanting surfaces 22*a* urge the slider 10 upwardly. At this stage, the pin contacts 31, mounted in the female connector 2, are not yet fitted respectively in the socket contacts 30 mounted in the male connector 1.

Then, when the fitting operation further proceeds, the slider 10 is pushed rearwardly against the resilient force of the compression springs 9, so that the housing lock 8, formed at the distal end of the lock arm 6, abuts against the slanting projection 23 of the female connector 2. At this stage, the pin contacts 31 are inserted respectively into the socket contacts 30, but are not disposed in complete electrical contact therewith.

If the pushing operation is stopped in this half-fitted condition, the male and female connectors 1 and 2 are returned or moved away from each other (that is, in a disconnecting direction opposite to the fitting direction) by the resilient force of the compression springs 9, and therefore such half-fitted condition can be easily detected.

Figure 6:
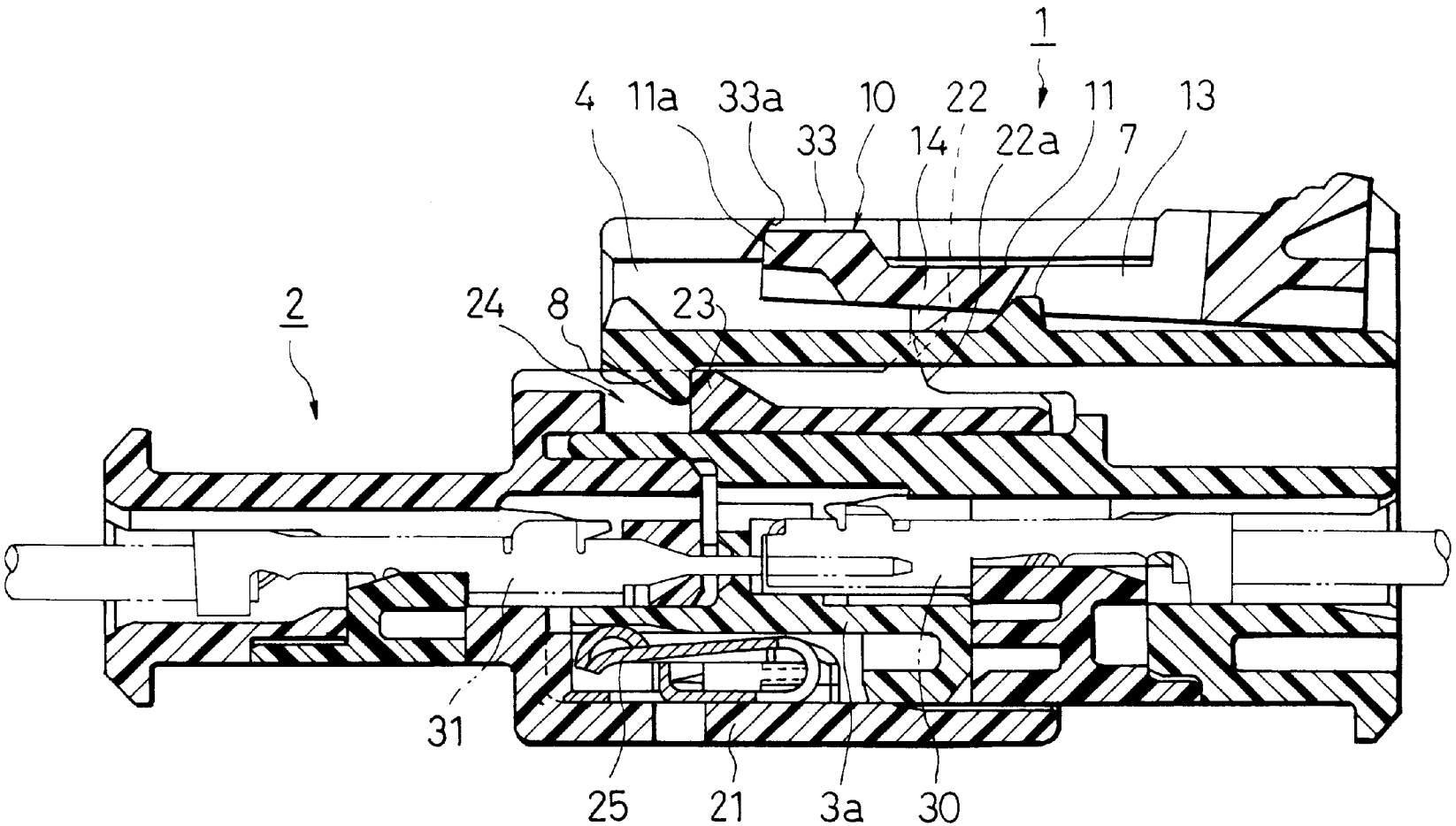
FIG. 6 is a view explanatory of the operation, showing a half-fitted condition of the female and male connectors.

Then, when the fitting operation further proceeds, the front edge of the slide groove 13 slides onto the sliding surface of the lock beak 7, thereby moving the front portion of the slider upwardly, so that the abutment of the stopper projections 22 with the abutment projections 14 of the slider 10 is released, as shown in FIG. 6. At this time, the front end portion 11*a* of the slider 10 is temporarily received in the notches 33 disposed above the slider, and therefore the front portion of the slider can be smoothly moved upward. Then, the housing lock 8, formed at the distal end of the lock arm 6, slides over the slanting projection 23, and begins to be engaged in the engagement groove 24.

Then, immediately, the front end portion 11*a* of the slider 10 is moved forward under the influence of the compression springs 9, and slides over the stopper projections 22, and abuts against the slanting front edges 33*a* of the notches 33. As a result, the front end portion 11*a* is returned to be again received in the slider receiving portion 4, and is moved forward to be returned to the initial position under the influence of the compression springs 9, and also the housing lock 8 is retainingly engaged in the engagement groove 24.

Therefore, the slider body 11 can be moved upward without being flexed, and therefore the connector-inserting force, required for the fitting operation, can be reduced. The short-circuited condition of the short-circuit spring 25, short-circuited to the pin contacts 31 in the female connector 2, is canceled by the front end of the connector housing 3*a* of the male connector 1.

Figure 7:
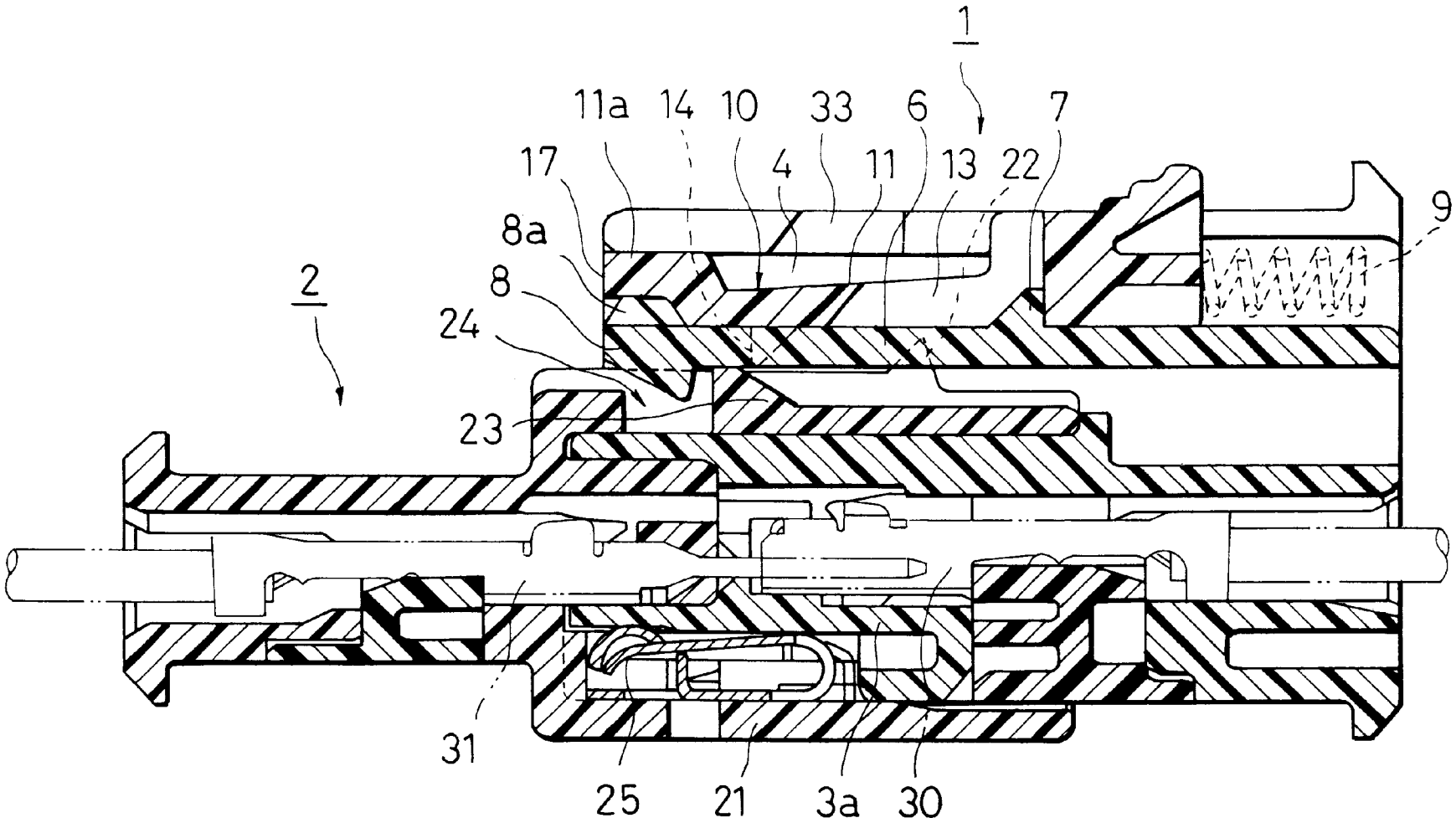
FIG. 7 is a view explanatory of the operation, showing a completely-fitted condition of the female and male connectors.

When the slider 10 is returned to the initial position under the influence of the compression springs 9 as shown in FIG. 7, the displacement prevention portion 17 of the slider 10 abuts against the displacement prevention projections 8*a* of the lock arm 6. As a result, the lock arm 6 is locked, and the female and male connectors are held in a completely-fitted condition, and the contacts 30 are completely connected to the contacts 31, respectively.

This completely-fitted condition can be detected through the sense of touch, obtained when the housing lock 8 of the lock arm 6 slides over the slanting projection 23, and also can be easily detected by viewing the position of the returned slider 10.

As described above, in the connector fitting construction of this embodiment, the notches 33 for allowing a temporary upward movement of the front end portion 11*a* of the slider body 11 are formed in the exclusive-use housing 3*b*, and the slanting surface 22*a* is formed on the front end of each of the stopper projections 22, and the slanting surface is formed on the front edge 33*a* of each of the notches 33.

Therefore, the abutment projections 14 of the slider 10, abutted respectively against the stopper projections 22, are urged upwardly by the slanting surfaces 22*a* of the stopper projections 22, respectively.

When the front edge of the slide groove 13 slides onto the slanting surface of the lock beak 7, the front end portion 11*a* of the slider is temporarily moved upward through the notches 33, and therefore the slider can be smoothly moved upward without flexing the front portion of the slider, and the abutment of the stopper projections 22 with the abutment projections 14 of the slider 10 can be released with a low inserting force.

Figure 8:
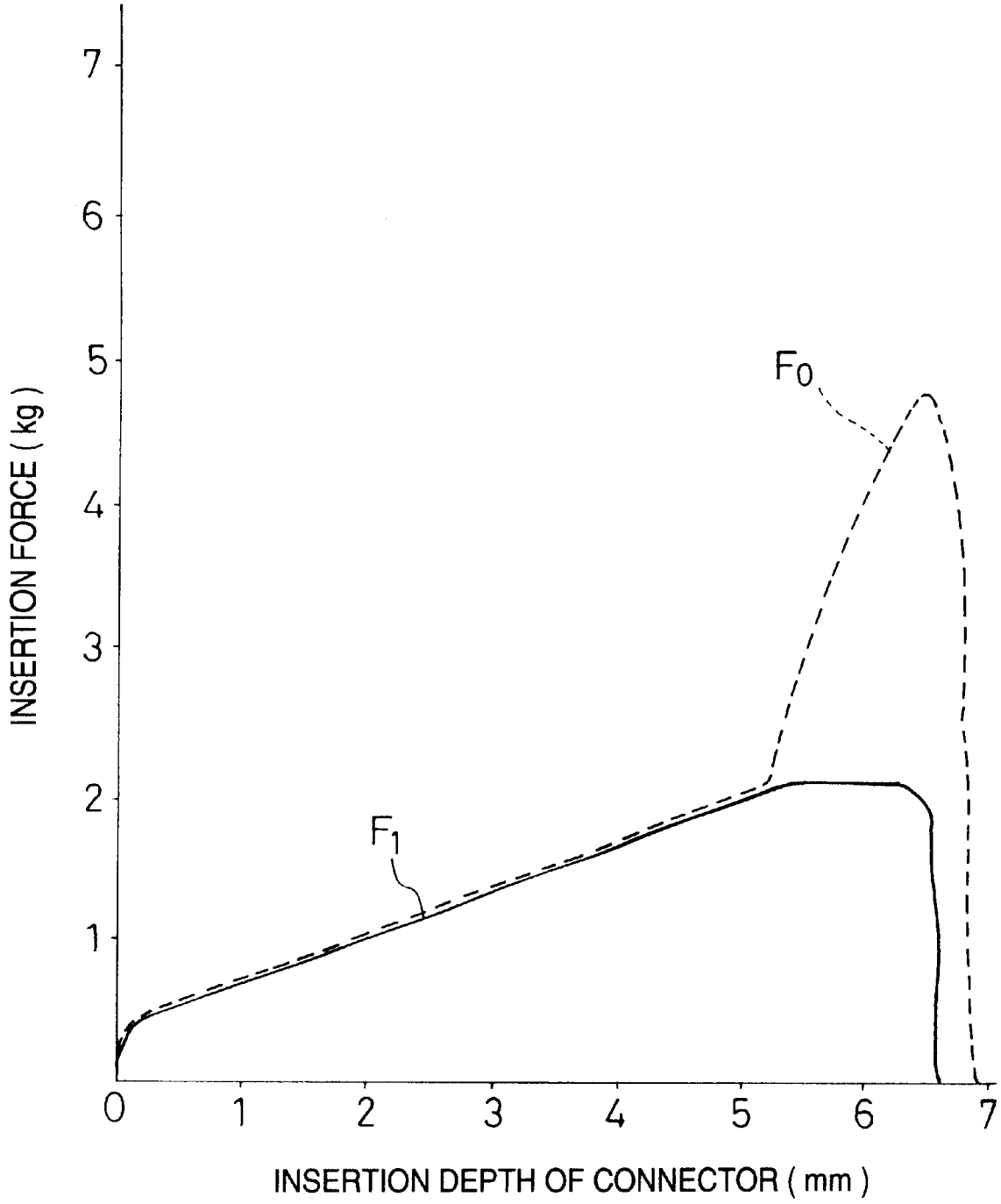
FIG. 8 is a graph showing a change of an inserting force required for fitting the female and male connectors of the present invention together.
Figure 9:
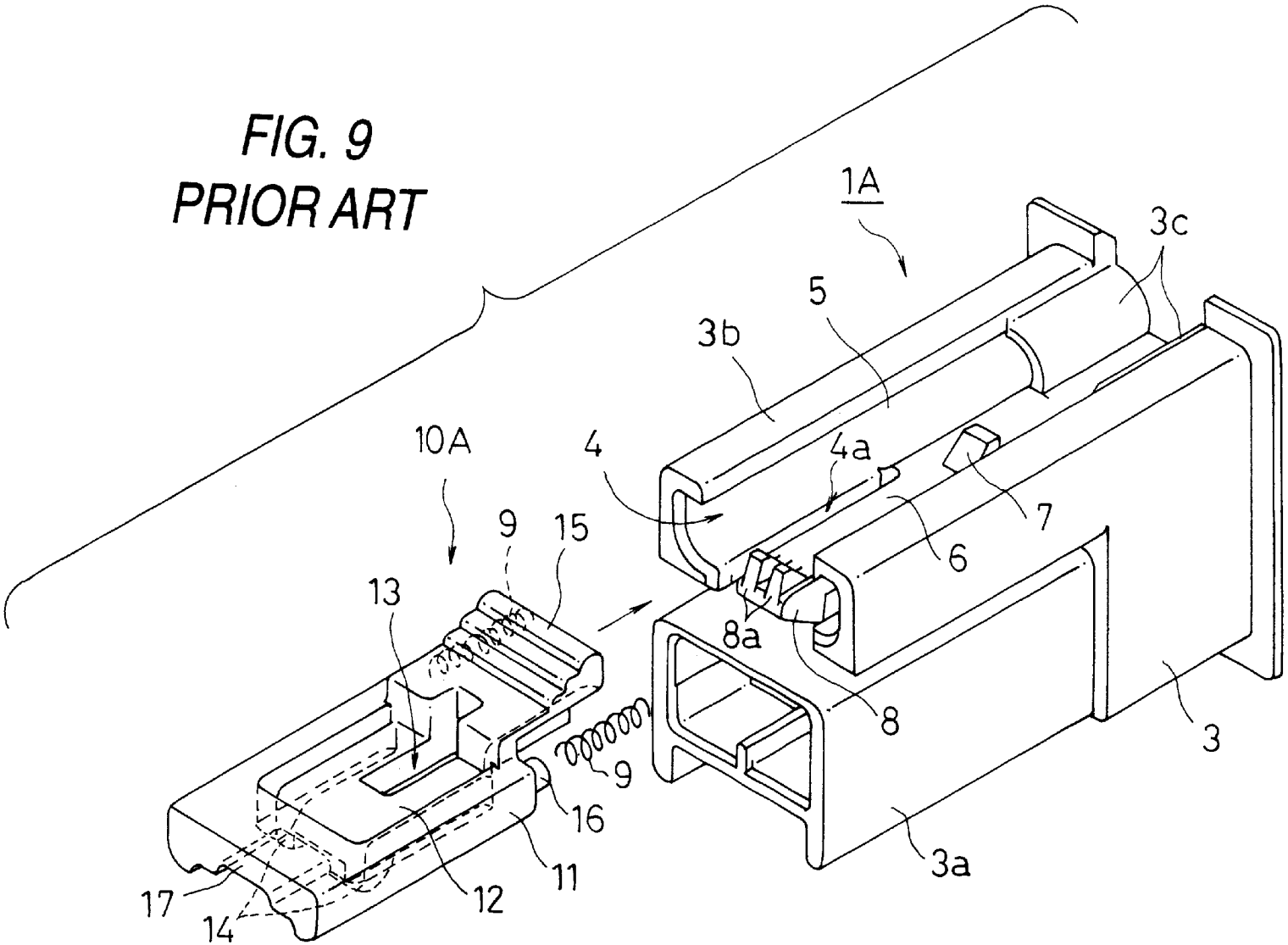
FIG. 9 PRIOR ART
FIG. 9 is an exploded, perspective view showing a male connector of the related connector fitting construction.
Figure 10:
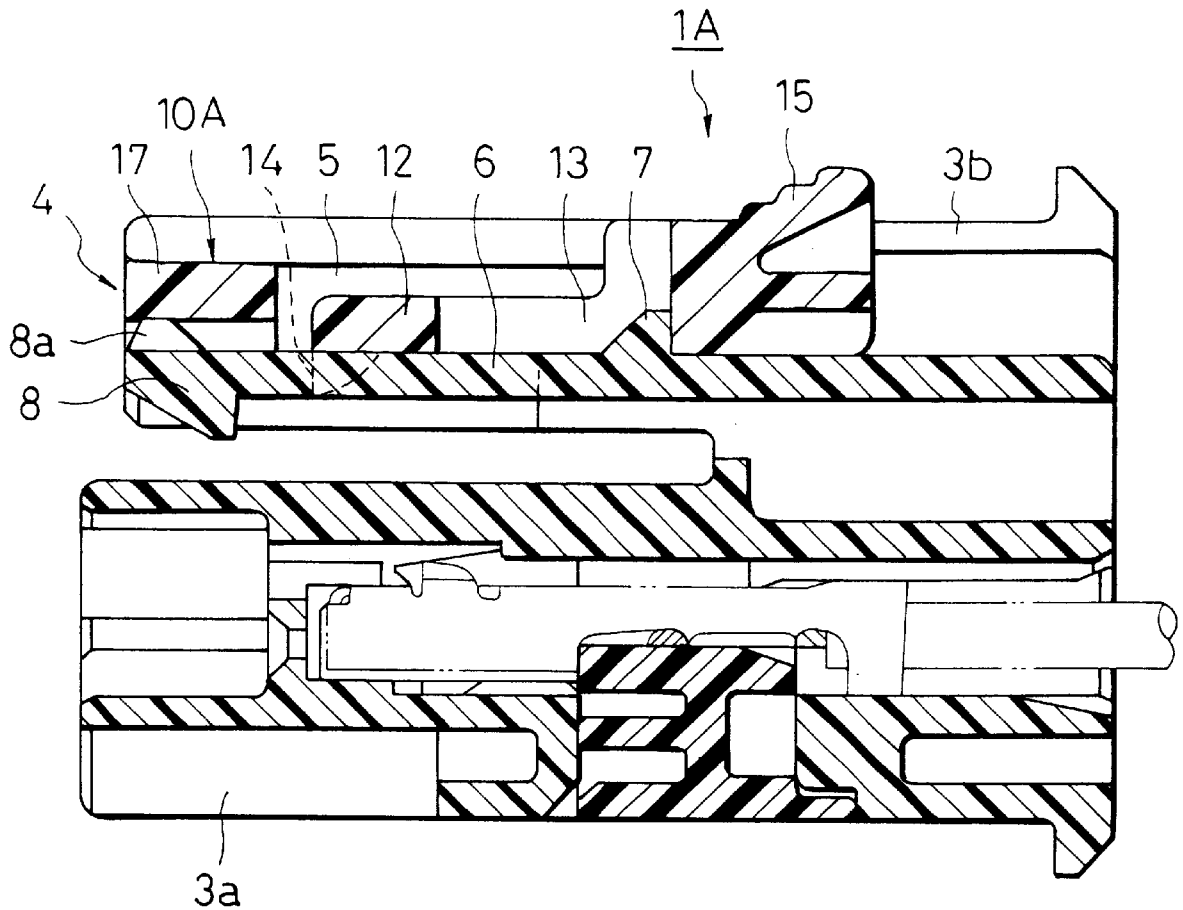
FIG. 10 PRIOR ART
FIG. 10 is a vertical cross-sectional view showing the male connector of FIG. 9 having a slider mounted therein.
Figure 11:
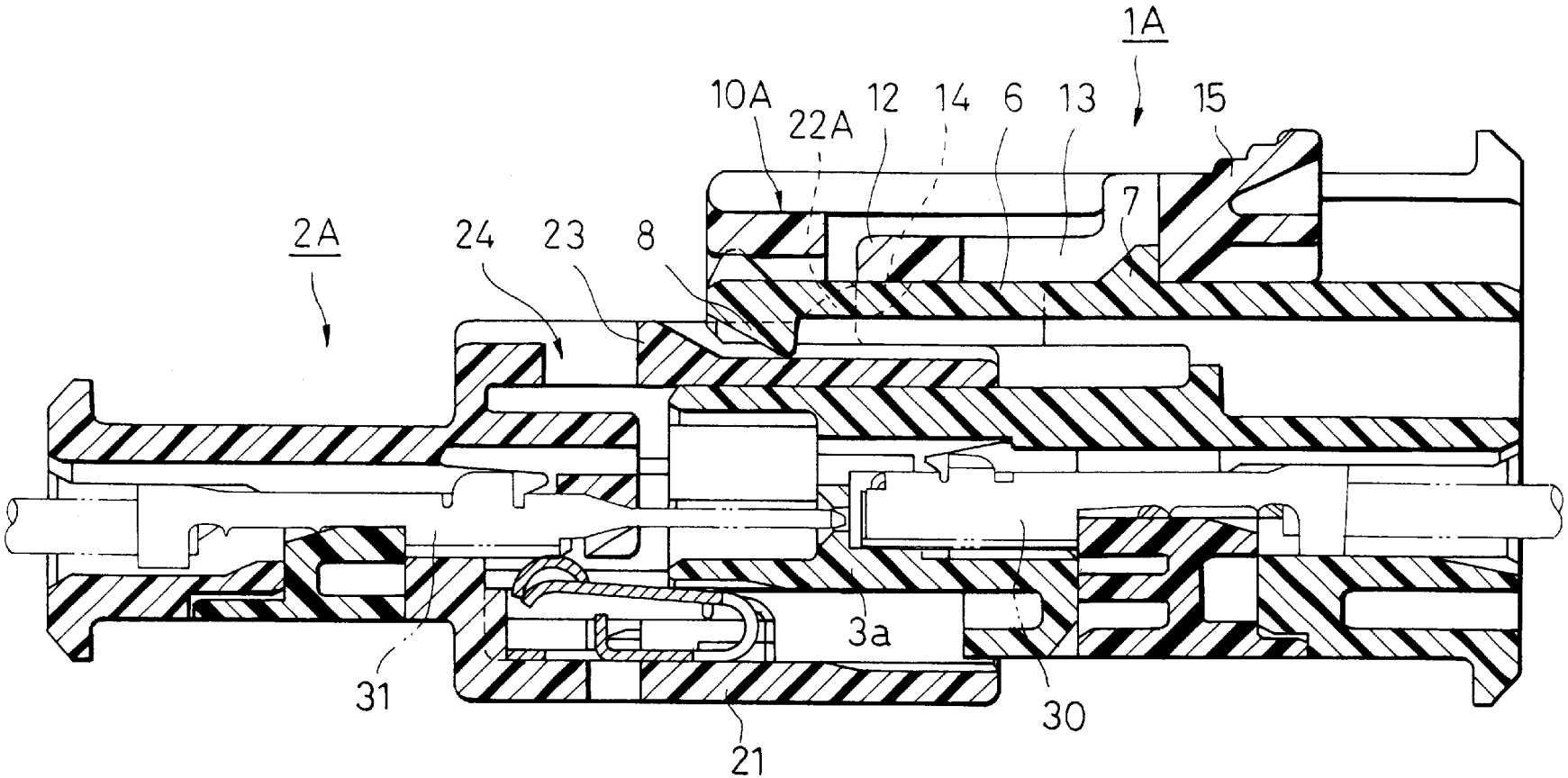
FIG. 11 PRIOR ART
FIG. 11 is a view explanatory of an operation, showing an initially-fitted condition of the related female and male connectors.
Figure 12:
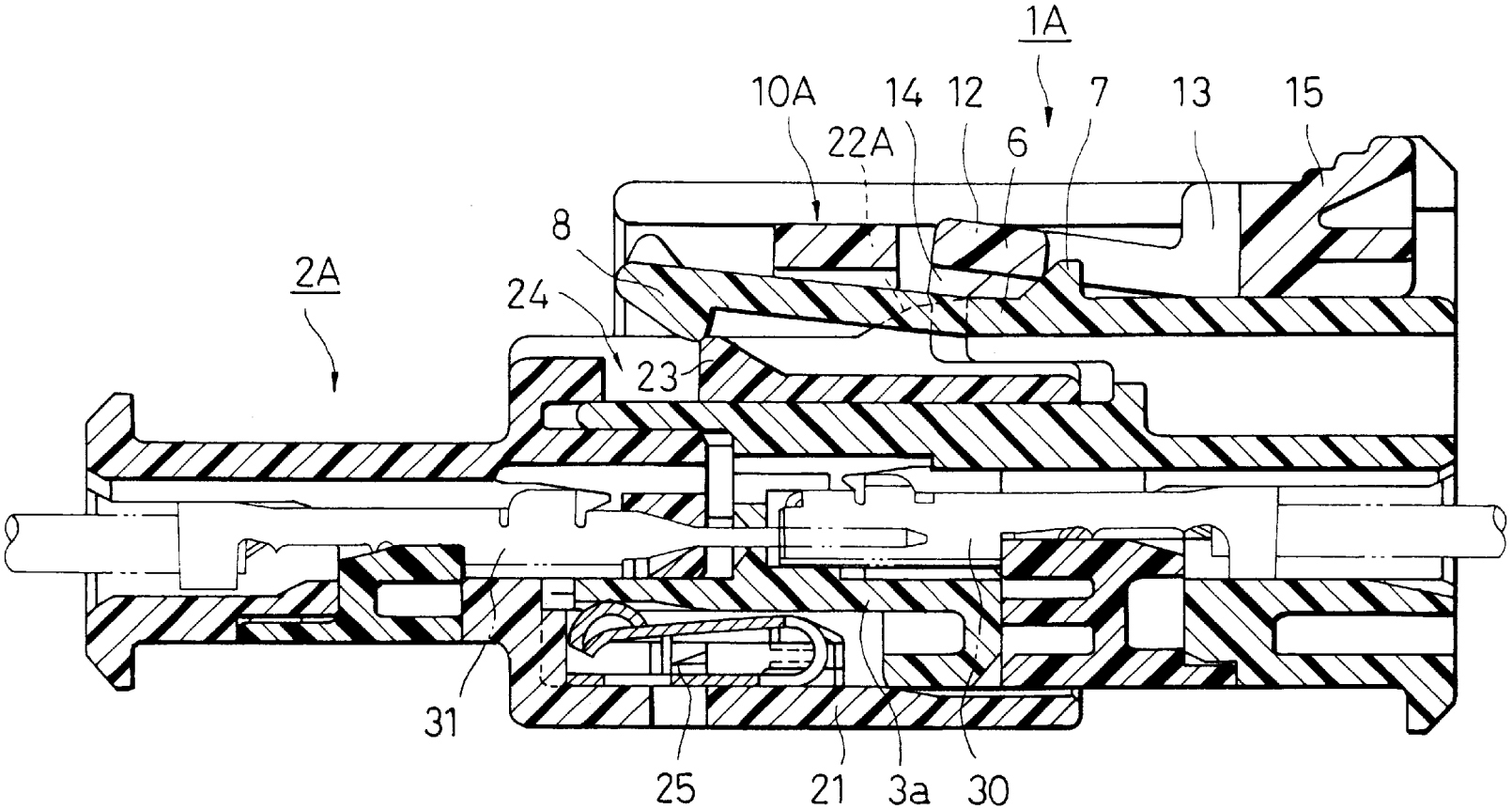
FIG. 12 PRIOR ART
FIG. 12 is a view explanatory of the operation, showing a half-fitted condition of the related female and male connectors.
Figure 13:
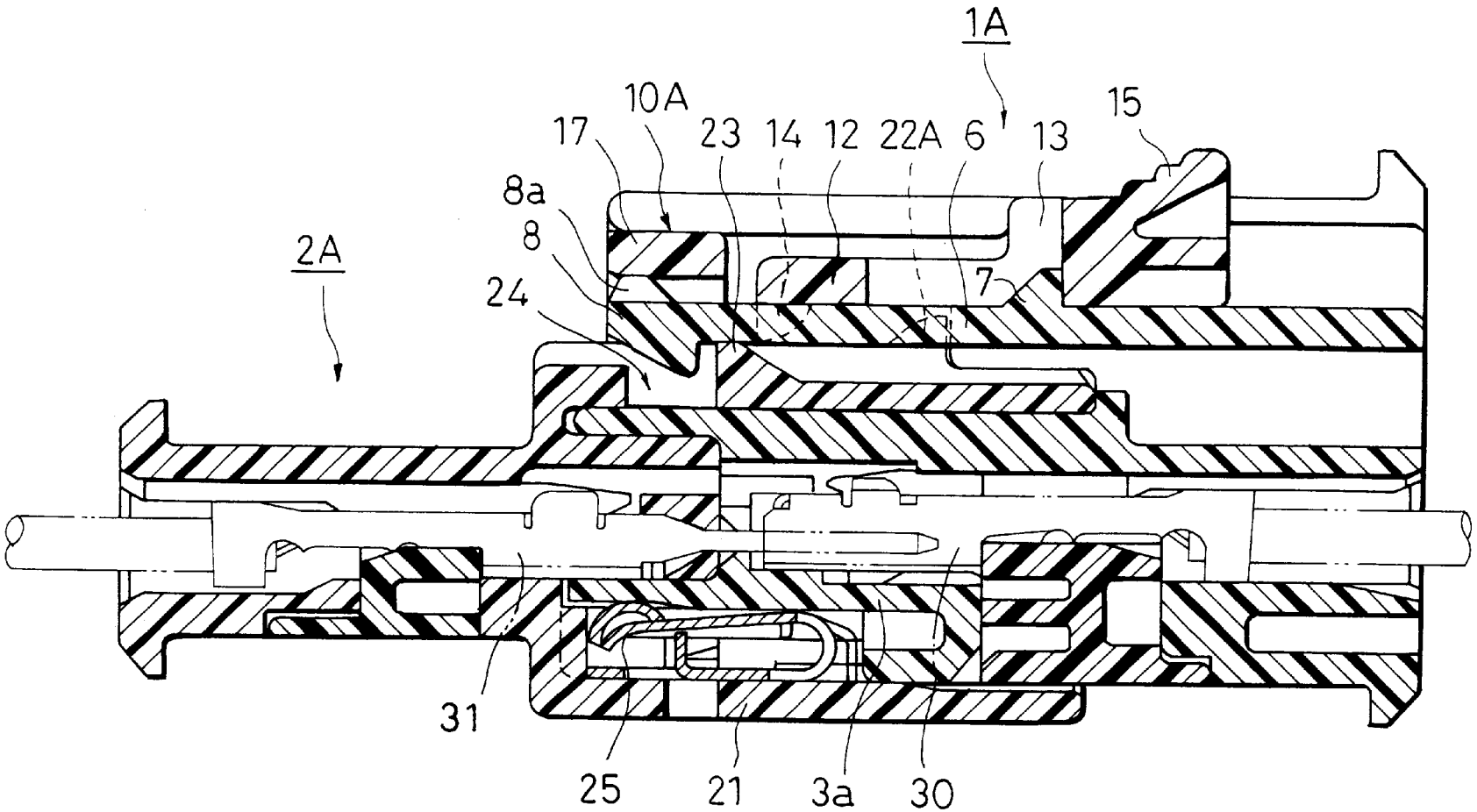
FIG. 13 PRIOR ART
FIG. 13 is a view explanatory of the operation, showing a completely-fitted condition of the related female and male connectors.

As shown in FIG. 8, as compared with an inserting force FO required for fitting the related male and female connectors together, the inserting force F1, required for fitting the male and female connectors 1 and 2 together does not need to be abruptly increased, and therefore the two connectors can be completely fitted together with the low inserting force.

Then, immediately, the front end portion 11*a* of the slider 10 is moved forward under the influence of the compression springs 9, and slides over the stopper projections 22, and abuts against the slanting front edges 33*a* of the notches 33, and is returned to be again received in the slider receiving portion 4, and is further moved forward to be returned to the initial position. Therefore, the connector-inserting force, required for the fitting operation, can be reduced, and the efficiency of the fitting operation can be enhanced.

The connector fitting construction of the present invention is not limited to the above embodiment, and can be applied to the other embodiments. Namely, in this embodiment, although the exclusive-use housing for receiving the slider is provided at the male connector while the stopper projections and so on are provided at the female connector, there can be provided a connector fitting construction of a reverse design in which an exclusive housing is provided at a female connector while stopper projections and so on are provided at a male connector.

As described above, in the connector fitting construction of the present invention, the housing has the notches for allowing a temporary upward movement of the front end portion of the slider body, and when the two connectors are to be fitted together, the slider is moved to the predetermined position at the rear portion of the housing against the resilient force of the spring members, and the front end portion of the slider is temporarily received in the notches disposed above the slider, and therefore the abutment of the abutment projections with the stopper projections is released.

The front end of each of the stopper projections has the forwardly downwardly-slanting surface, and the front edge of each of the notches has the forwardly downwardly-slanting surface.

Therefore, the front portion of the slider, abutted against the stopper projections, is urged upwardly by the slanting surfaces of the stopper projections, and the front end portion of the slider is temporarily received in the notches disposed above the slider, and therefore the front portion of the slider can be smoothly moved upward. Then, immediately, the front end portion of the slider slides over the stopper projections, and abuts against the front edges of the notches, and is returned to be again received in the slider receiving portion, and is further moved forward to be returned to the initial position.

Therefore, a half-fitted condition is positively prevented during the fitting operation for the pair of female and male connectors, and since the front portion of the slider is moved upward without flexing the slider body, the connector-inserting force, required for fitting the female and male connectors together can be reduced, and the two connectors can be fitted together with the low inserting force, and the efficiency of the fitting operation can be enhanced.

What is claimed is:

1. A connector fitting construction, comprising:

a female connector including a housing into which a terminal is insertable;

a male connector fittable to the female connector, the male connector including a housing into which another terminal is insertable;

wherein one of the female and male connectors including a slider receiving portion, and the other one of the female and male connectors including a pair of stopper projections formed on the housing thereof;

a spring member receivable in the housing of one of the female and male connectors;

a slider slidably insertable in the slider receiving portion, the slider having a pair of abutment projections; and a notch, in which a front end portion of the slider is receivable, formed above the slider receiving portion;

wherein, when the female and male connectors are fitted to each other, the abutment projections respectively abut against the stopper projections, the slider is moved rearwardly in the slider receiving portion against a resilient force of the spring member, and the front end portion of the slider is received in the notch so as to release abutment of the abutment projections with the stopper projections.

2. The connector fitting construction of claim 1, wherein each of the stopper projections has a forwardly downwardly-slanting surface formed on a front end thereof, and the notch has a forwardly downwardly-slanting surface formed on a front edge thereof.

3. The connector fitting construction of claim 1, wherein the slider is moved forwardly in the slider receiving portion in accordance with the resilient force of the spring member as the abutment of the abutment projections with the stopper projections is released.

4. The connector fitting construction of claim 1, wherein one of the female and male connectors includes a lock arm having a lock beak with a sliding surface, and the slider includes a groove formed therein, and wherein the front end portion of the slider is moved upwardly so as to be received in the notch as a front edge of the groove slides onto the sliding surface of the lock beak.

5. The connector fitting construction of claim 1, wherein a half-fitted condition of the female and male connectors is prevented by the resilient force of the spring member.

* * * * *